US008769921B2

(12) United States Patent
Joye et al.

(10) Patent No.: US 8,769,921 B2
(45) Date of Patent: Jul. 8, 2014

(54) METHOD AND DEVICE FOR PROTECTING THE END OF AN ANCHORED CABLE

(75) Inventors: Stephane Joye, Boulogne-Billancourt (FR); Yannick Le Goff, Paris (FR)

(73) Assignee: Soletanche Freyssinet, Rueil Malmaison (FR)

( * ) Notice: Subject to any disclaimer, the term of this patent is extended or adjusted under 35 U.S.C. 154(b) by 0 days.

(21) Appl. No.: 13/440,327

(22) Filed: Apr. 5, 2012

(65) Prior Publication Data

US 2012/0255272 A1 Oct. 11, 2012

(30) Foreign Application Priority Data

Apr. 7, 2011 (FR) ..... 11 53028

(51) Int. Cl.
*E01D 19/14* (2006.01)

(52) U.S. Cl.
USPC ..... 57/3

(58) Field of Classification Search
USPC ..... 57/3, 127; 14/21, 22
See application file for complete search history.

(56) References Cited

U.S. PATENT DOCUMENTS

| | | | | |
|---|---|---|---|---|
| 3,548,432 | A * | 12/1970 | Durkee et al. | 14/21 |
| 4,648,146 | A * | 3/1987 | Nutzel et al. | 14/21 |
| 5,809,710 | A * | 9/1998 | Jungwirth et al. | 52/223.1 |
| 6,571,518 | B1 * | 6/2003 | Barley | 52/223.13 |
| 6,578,328 | B2 * | 6/2003 | Bournand et al. | 52/223.13 |
| 6,634,147 | B2 * | 10/2003 | Nutzel | 52/223.1 |
| 6,715,176 | B2 * | 4/2004 | Stubler et al. | 14/22 |
| 6,880,193 | B2 * | 4/2005 | Figg et al. | 14/21 |
| 7,003,835 | B2 * | 2/2006 | Figg et al. | 14/21 |
| 7,174,684 | B2 * | 2/2007 | Nuetzel et al. | 52/223.13 |
| 7,181,890 | B2 * | 2/2007 | Nuetzel | 52/223.13 |
| 2002/0088105 | A1 * | 7/2002 | Nutzel | 29/452 |
| 2002/0108329 | A1 * | 8/2002 | Bournand et al. | 52/223.13 |
| 2003/0182739 | A1 * | 10/2003 | Figg et al. | 14/22 |

FOREIGN PATENT DOCUMENTS

| | | | |
|---|---|---|---|
| DE | 9012786 | U1 | 11/1990 |
| DE | 198 82 104 | C1 | 4/2001 |
| EP | 0 323 285 | A1 | 7/1989 |
| EP | 1215347 | A2 | 6/2002 |
| EP | 1 227 200 | A1 | 7/2002 |
| JP | 8-74210 | A | 3/1996 |
| WO | WO 01/20098 | A1 | 3/2001 |

* cited by examiner

*Primary Examiner* — Shaun R Hurley
(74) *Attorney, Agent, or Firm* — Mckenna Long & Aldridge LLP

(57) ABSTRACT

To protect the end of a cable composed of a set of tendons individually held in an anchorage system, the device comprises a skirt extending from the front of the anchorage system and placed around the set of tendons, and several sleeves. The tendons have respective end portions which extend beyond the front of the anchorage system and which are individually received in the sleeves, said sleeves being sealed off beyond the end portions of the tendons. A connection between the skirt and the sleeves encloses a chamber delimited by the front of the anchorage system, the skirt, and the sleeves, the connection comprising an active stuffing box kind of system. The volume of this chamber is filled in with a filling product.

9 Claims, 3 Drawing Sheets

METHOD AND DEVICE FOR PROTECTING THE END OF AN ANCHORED CABLE

This application claims priority to French Patent Application No: 1153028, filed Apr. 7, 2011, the content of which is incorporated by reference in its entirety for all purposes as if fully set forth herein.

BACKGROUND OF THE INVENTION

The invention relates to the field of structural cables used in construction. It applies, in particular, to the anchorage of stay cables or prestressing cables.

Such structural cables are often made of a plurality of parallel tendons, such as strands for example. Their ends are anchored by means of blocks having throughholes where the tendons are individually blocked, for example by means of split frusto-conical jaws. The tendons have excess lengths extending beyond the anchorage blocks, which makes it possible to hold onto them when tensioning and anchoring the cable. It is common to retain this excess length so that the cable can be slackened at a later time.

As an example, this excess length may be 3 millimeters per meter of cable. For very long cables (several hundred meters for example), the excess length can become fairly cumbersome.

A constant concern of those who work with such structural cables is protecting the metal of the tendons against corrosion. Various anticorrosion techniques are used to protect the main portion of the cable and the portion in the anchorages (for example see WO 01/20098 A1).

In general, the metal of the tendons is exposed in the anchorage area. A cover is placed over the excess length of the tendons which extend beyond the front side of the anchorage system, and inside this cover a filling product is injected such as wax, grease, a polymer, a resin, or cement grout. The length of the cover must be greater than the excess lengths of the tendons extending beyond the anchorage system. The cover is therefore voluminous in the case of relatively long cables.

The space required by the arrangement on the front side of the anchorage can be problematic in certain configurations. By way of example of such a configuration, the stay cable anchorages on the pylons of cable-stayed bridges can be mentioned. The stays 12 generally form webs of inclined cables on each side of the pylon 14, as illustrated in FIG. 1. When the anchorages 15 are opposite one another in the pylon 14, the space occupied by the covers may interfere geometrically, as can be seen in the case of the covers 16 indicated by dotted lines in FIG. 2.

One solution to this problem consists of making covers that are curved in shape. However, this is not a satisfactory solution. The energy necessary to curve the bundle of tendons and maintain them in this position is very high. The attachments for the cover must then be particularly robust. Any maintenance operation which involves opening the cover becomes more difficult. In addition, a curved cover may make it impossible to position the jack used to manipulate the cable tendons.

A need therefore exists for a protection for the excess lengths of the tendons of an anchored cable, which limits the occurrence of the above space requirement problems.

SUMMARY OF THE INVENTION

A device is proposed for protecting an end of a cable composed of a set of tendons individually held in an anchorage system, the tendons having respective end portions which extend beyond a front side of the anchorage system. This device comprises:

- a skirt extending from the front side of the anchorage system and placed around the set of tendons;
- a plurality of sleeves, each sleeve being placed around at least one respective tendon of the cable and being sealed off beyond the end portion of this tendon;
- a connection between the skirt and the sleeves, to enclose a chamber delimited by the front side of the anchorage system, the skirt, and the sleeves, the connection comprising an active stuffing box system; and
- a filling product to fill in an internal volume of the chamber.

The space requirement for the device is reduced, as it is no longer necessary to reserve a cylindrical volume, larger than the set of tendons emerging from the anchorage system and longer than the excess lengths of these tendons, to accommodate a protective cover in front of the anchorage system. A good portion of the excess length of the tendons is contained in a simple sleeve having a transverse cross-section that is substantially smaller than the skirt, containing a limited number of tendons of the cable, preferably a single tendon. These sleeves each have a reduced cross-section and space can be left between them to accommodate other elements, particularly the sleeves of a similar protective device equipping another anchorage system located nearby.

Advantageously, the sleeves are less rigid than the cable tendons, which allows bending the sleeved tendons when necessary for maintenance work or to allow two cable ends to overlap. In general, the sleeves are also less rigid than the skirt.

The connection between the skirt and the sleeves can be achieved by bonding or welding. In another embodiment, the connection between the skirt and the sleeves comprises an active stuffing box system. This system may comprise three parallel plates traversed by holes arranged to allow the sleeves to pass through, two of them being rigid plates sandwiching a deformable plate. One of the rigid plates is peripherally connected to the skirt. The stuffing box system additionally comprises an actuating mechanism for pressing the two rigid plates towards each other and thus compressing the deformable plate between them to form a seal along the sleeve passage.

Another aspect of the invention relates to a method for protecting an end of a cable comprising of a set of tendons individually held in an anchorage system, the tendons having respective end portions which extend beyond a front side of the anchorage system. The method comprises:

- installing a skirt against the front side of the anchorage system, placing the skirt around the set of tendons;
- installing a plurality of sleeves, each sleeve being placed around at least one respective tendon of the cable and being sealed off beyond the end portion of this tendon;
- connecting the sleeves to the skirt with an active stuffing box-type of system, to enclose a chamber delimited by the front side of the anchorage system, the skirt, and the sleeves; and
- injecting a filling product to fill in an internal volume of the chamber.

In an embodiment of the method, the sleeves contain soft or pliable filling product before they are installed onto the end portions of the cable tendons.

BRIEF DESCRIPTION OF THE DRAWINGS

Other features and advantages of the invention will be apparent from the following description of a non-limiting example of one embodiment, with reference to the attached drawings in which.

DESCRIPTION OF PREFERRED EMBODIMENTS

An exemplary protective device of the type proposed here is a cover having two parts:

- a common rigid part located on the side of the cable anchorage system;
- an individual more flexible part, located on the side furthest from the anchorage.

Figure 3:
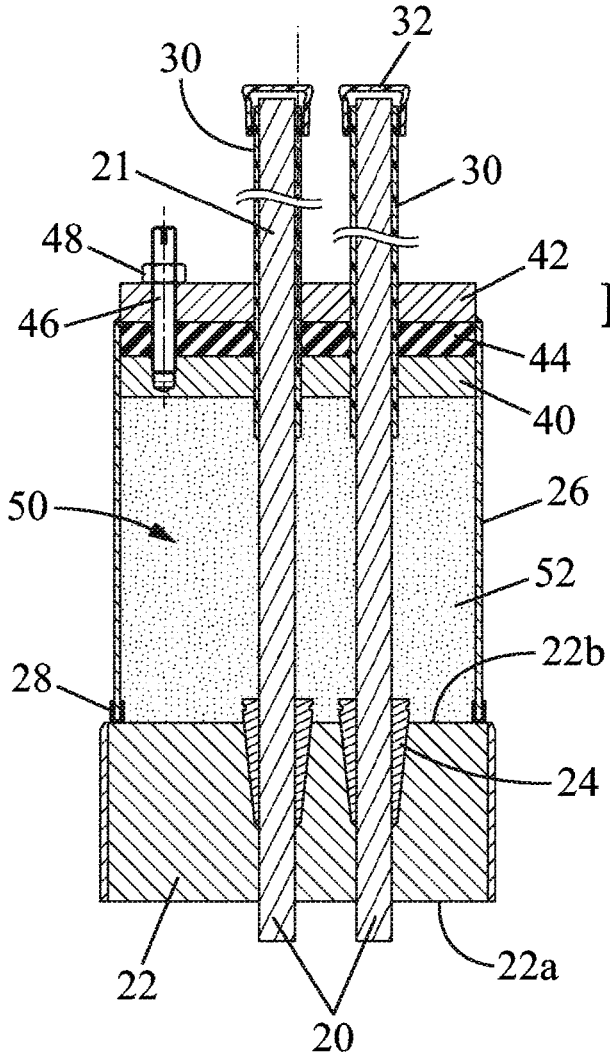
FIG. 3 is an axial cross-sectional view of an example of a protective device of the invention.

FIG. 3 shows the terminal portion of a cable having its component tendons 20 held in an anchorage block 22 by means of split frusto-conical jaws 24.

The block 22 is part of an anchorage system additionally comprising a support surface for the cabled structure, against which the block is directly or indirectly applied. The system may possibly also comprise one or more intermediate support plates, a screw nut for adjusting the cable tension, etc.

The cable can consist of any number of parallel tendons 20. Only two tendons are represented in FIG. 3 to simplify the drawing.

The anchorage block 22 is traversed by throughholes between its rear side 22*a* and its front side 22*b*. These throughholes are arranged so that they individually accept the tendons 20 of the cable. Such a throughhole widens at the front side 22*b* of the block in order to accommodate the split frusto-conical jaw 24 around the tendon 20. The jaw 24 thus immobilizes the tendon 20 in its throughhole by the wedge effect from the traction applied to the cable.

An excess length of each tendon 20 extends beyond the front side of the anchorage system. The excess length may be several dozen centimeters.

The common portion of the two-part cover consists of a skirt 26 which extends from the front side of the anchorage system. The skirt 26 is, for example, made of metal or plastic. It is attached to the anchorage system by a means not represented in FIG. 3, for example a clamp bolted to the block 22 or another element of the anchorage system, or threading on the inner surface of the skirt and engaging with a complementary peripheral thread on the block 22.

There is a fluid-tight seal between the back side of the skirt 26 and the front of the anchorage system, to avoid leaks of the filling product injected inside the skirt. In the example in FIG. 3, the skirt 26 is placed against the front 22*b* of the anchoring block 22 with an intermediate gasket 28. It may also be placed against an element of the anchorage system other than the block 22, establishing a fluid-tight seal at the perimeter of the contact area. It is sufficient for the skirt to delimit a substantially fluid-tight chamber enclosing the excess lengths of the tendons 20, once applied to the structure and covered on the front side. In one variant, the skirt 26 may be part of a piece of the anchorage system.

The individual portion of the two-part cover consists of sleeves 30 which each contain the end portion 21 of one of the cable tendons 20. Their cross-section is slightly larger than that of the tendons 20. In the example represented in FIG. 3, the end of each sleeve 30 is hermetically closed by a cap 32 covering that end.

The sleeves 30 are preferably less rigid than the skirt 26. They can thus be individually bent without deforming the skirt 26. They can also be configured to be less rigid than the cable tendons 20, to avoid substantially reducing the ability to bend the end portions 21 that they hold. The sleeves 30 may be made of plastic, such as polyolefin for example. Low density polyethylene (LDPE) is an appropriate choice of material.

On the front side of the device, the sleeves 30 are connected to the skirt 26 by a connection which can assume various forms.

One possibility is to bond or weld the sleeves to the skirt, which then comprises a perforated front side; the sleeves 30 engage with the perforations and are peripherally welded. Such an embodiment is suitable when the skirt 26 and the sleeves 30 are designed to form a prefabricated covering member.

Another possibility, illustrated in FIG. 3, is to establish the connection between the skirt 26 and the sleeves 30 using an active stuffing box system.

The stuffing box system represented in FIG. 3 has two rigid plates 40, 42, one of them, for example the inner plate 40, being integrally attached along its edges to the inner surface of the skirt 26, while the other is mobile. These plates 40, 42 are traversed by openings having a cross-section slightly larger than the individual cross-section of a sleeve 30, and they are aligned with the positions of the tendons 20 emerging from the front of the anchorage block 22. These openings thus allow the sleeves 30 on the end portions 21 of the tendons 20 to pass through. Another plate 44 of the same shape is sandwiched between the two rigid plates 40, 42. This plate 44 is of a deformable material such as an elastomer.

An actuating mechanism, consisting for example of several threaded rods 46 distributed around the border of the plates 40, 42, 44 and associated with respective nuts 48, is used to press the rigid plates 40, 42 towards each other. The deformable plate 44 is then compressed to form the seal around the sleeves 30. In the example represented, each threaded rod 46 engages with an internal thread on the rigid inner plate 40 and passes through aligned holes in the other plates 44 and 42. Tightening the nut 48 on the threaded rod 46 on the front side of the system, against the front face of the plate 42, then reversibly actuates the stuffing box system.

The operations for assembling the device consist of first placing the skirt 26 against the front side of the anchorage system and equipping it with the plates 40, 42, 44 of the skirt-sleeve connection, without tightening them. The sleeves 30 are then threaded onto the end portions 21 of the tendons 20. It is useful to introduce into the sleeves 30 beforehand a soft or pliable filling product, such as grease, to limit the risk that there are unfilled areas remaining at the end of the operation. The stuffing box is then tightened to seal off the chamber 50 delimited by the front side of the anchorage system, the skirt 26, and the inner plate 40.

Once the skirt 26, the sleeves 30, and their connection have been installed onto the anchor head, a filling product 52 is injected into the volume of the chamber 50.

This filling product 52 has properties that protect metal from corrosion. For example it can be petroleum wax, grease, resin, a polymer, etc. It is injected in fluid form through an injection opening (not represented), typically placed at a lower point of the chamber. A vent may be placed at an upper point of the chamber for venting the air it contains during injection. Once the filling product 52 overflows through the vent, it is sealed off, as is the injection opening.

Figure 1:
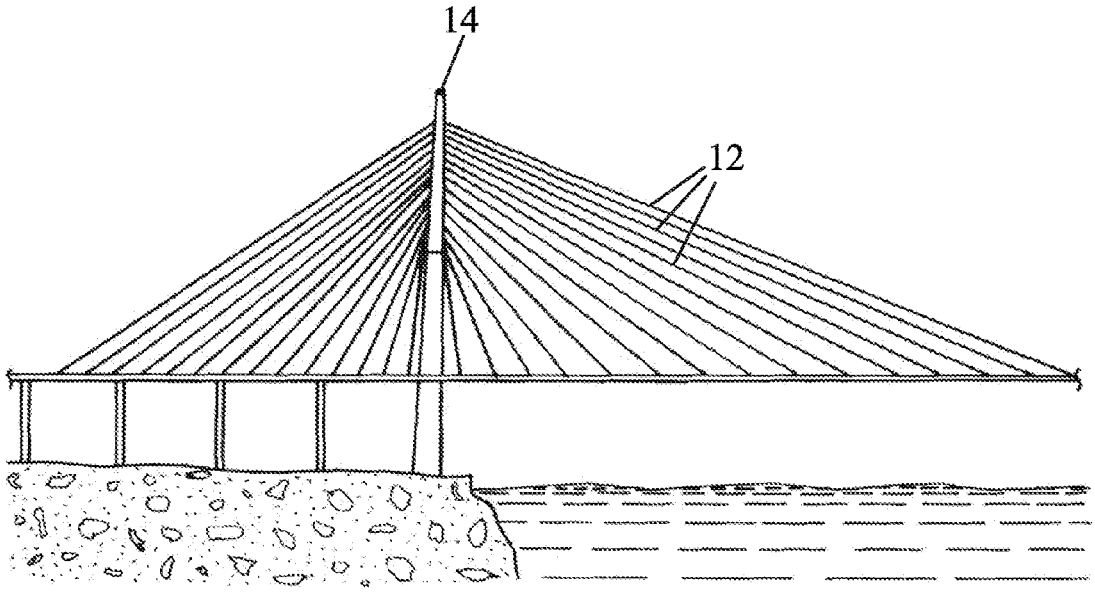
FIG. 1, mentioned above, is a schematic view of a cable-stayed bridge.
Figure 2:
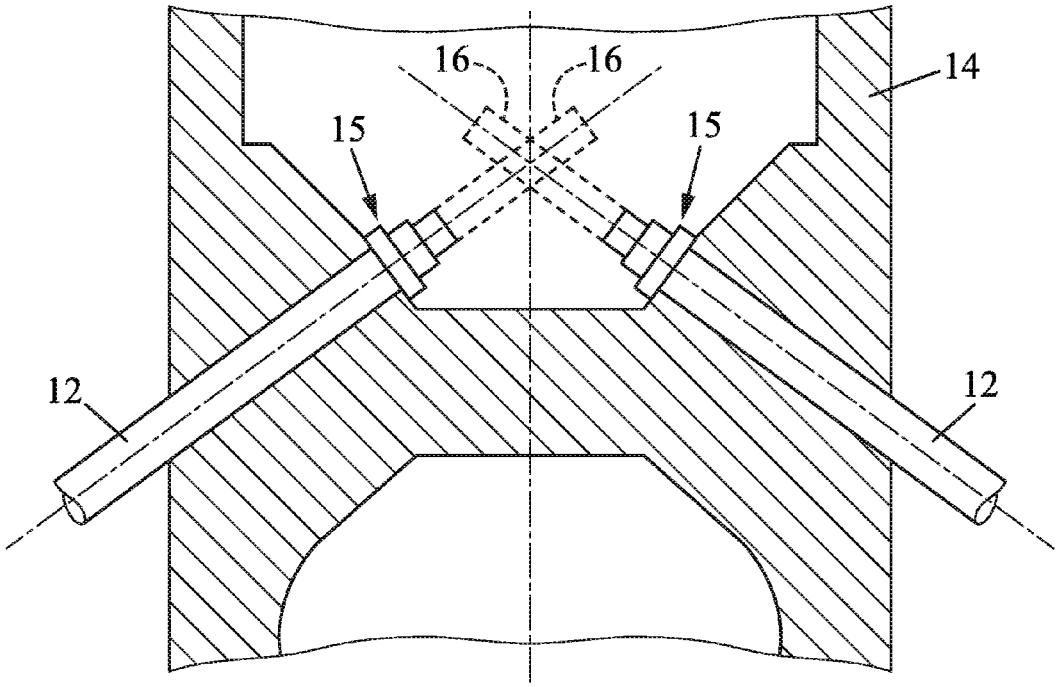
FIG. 2, mentioned above, is a cross-sectional diagram showing the anchorage zones of two opposing stays on the pylon of a cable-stayed bridge of the type shown in FIG. 1.
Figure 4:
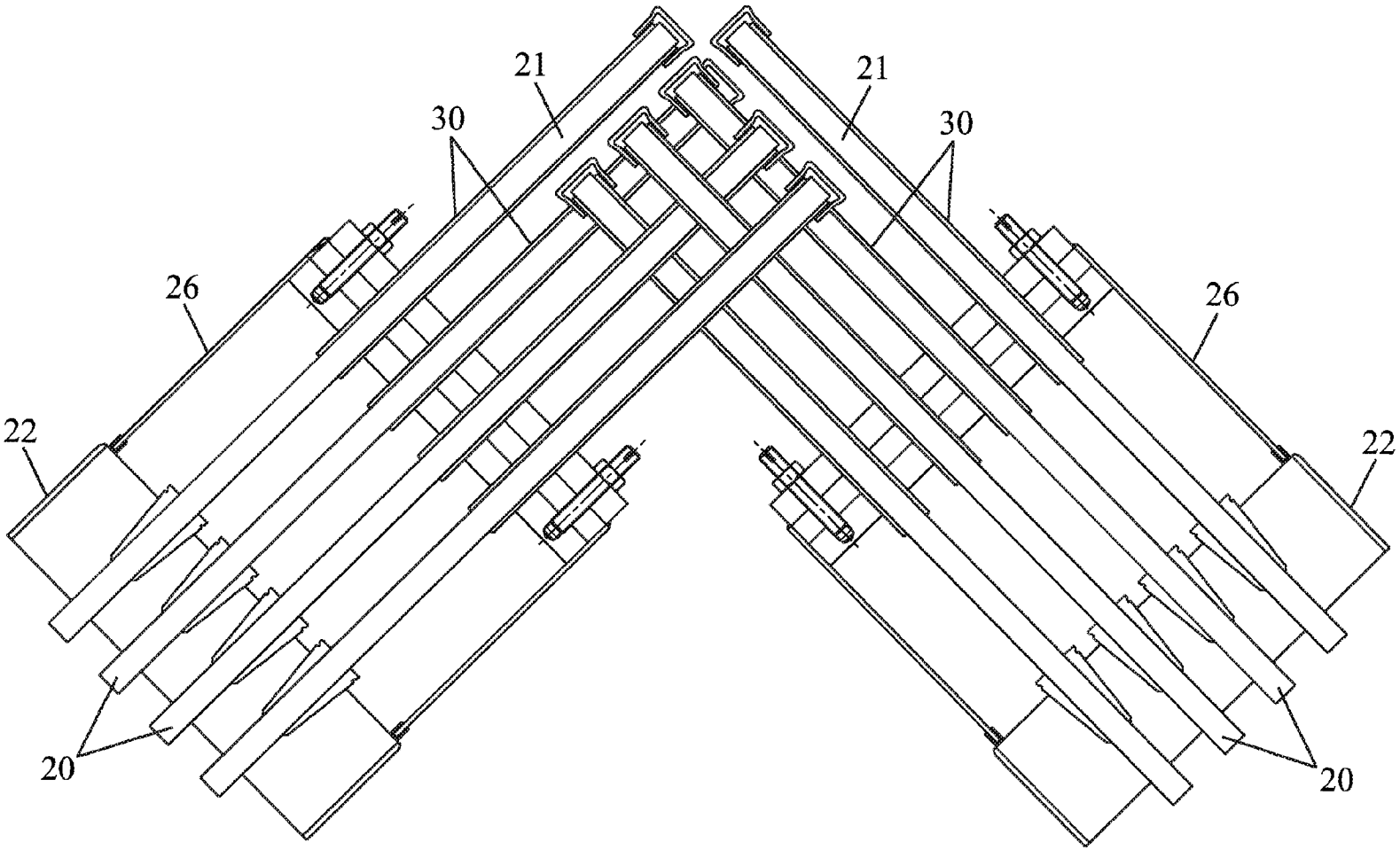
FIG. 4 is a diagram showing the ends of two structural cables fitted with the protective devices of the invention.

FIG. 4 schematically illustrates the adjacent anchor heads for two stays having an arrangement similar to the one illustrated in FIG. 2. One can see that the excess lengths of the tendons 20 of the two cables can overlap while still being protected, which facilitates the flexibility of the sleeves 30. The geometric issues arising from the conventional protections illustrated in FIG. 2 are thus resolved.

The embodiments described above are illustrations of the invention. Various modifications can be made to them without leaving the scope of the invention.

What is claimed is:

1. A device for protecting an end of a cable, the cable comprising a set of tendons individually held in an anchorage system, the tendons having respective end portions which extend beyond a front side of the anchorage system, said device comprising:

a skirt extending from the front side of the anchorage system and placed around the set of tendons;

a plurality of sleeves, each sleeve being placed around at least one respective tendon of the cable and being sealed off beyond the end portion of said tendon;

a connection between the skirt and the sleeves, to enclose a chamber delimited by the front side of the anchorage system, the skirt, and the sleeves, said connection comprising an active stuffing box system; and a filling product to fill in an internal volume of the chamber.

2. The device of claim 1, wherein each sleeve contains a single tendon of the cable.

3. The device of claim 1, wherein the sleeves are less rigid than the tendons of the cable.

4. The device of claim 1, wherein the sleeves are less rigid than the skirt.

5. The device of claim 1, wherein the stuffing box system comprises three parallel plates traversed by holes arranged to allow the sleeves to pass through, two of them being rigid plates sandwiching a deformable plate, one of the rigid plates being peripherally connected to the skirt, the stuffing box system further comprising an actuating mechanism for pressing the two rigid plates towards each other and thus compressing the deformable plate between them to form a seal along the sleeve passage.

6. A method for protecting an end of a cable, the cable comprising a set of tendons individually held in an anchorage system, the tendons having respective end portions which extend beyond a front side of the anchorage system, the method comprising:

installing a skirt against the front side of the anchorage system, placing the skirt around the set of tendons;

installing a plurality of sleeves, each sleeve being placed around at least one respective tendon of the cable and being sealed off beyond the end portion of said tendon;

connecting the sleeves to the skirt with an active stuffing box system, to enclose a chamber delimited by the front side of the anchorage system, the skirt, and the sleeves; and injecting a filling product to fill in an internal volume of the chamber.

7. The method of claim 6, wherein each sleeve is placed around a single tendon of the cable.

8. The method of claim 6, wherein the sleeves contain soft or pliable filling product before they are installed onto the end portions of the cable tendons.

9. The method of claim 6, wherein the sleeves are less rigid than the cable tendons and/or the skirt.

* * * * *